United States Patent [19]

Masoner

[11] 4,163,380

[45] Aug. 7, 1979

[54] FORMING OF PRECONSOLIDATED METAL MATRIX COMPOSITES

[75] Inventor: Vernon W. Masoner, Woodstock, Ga.

[73] Assignee: Lockheed Corporation, Burbank, Calif.

[21] Appl. No.: 841,005

[22] Filed: Oct. 11, 1977

[51] Int. Cl.[2] ..... B21D 5/00

[52] U.S. Cl. ..... 72/342; 29/419 R; 72/700; 428/611

[58] Field of Search ..... 29/419 R, 424; 72/342, 72/364, 700; 428/595, 608, 611, 627

[56] References Cited

U.S. PATENT DOCUMENTS

| | | | |
|---|---|---|---|
| 3,340,714 | 9/1967 | Pohl et al. | 72/342 |
| 3,793,700 | 2/1974 | Maikish et al. | 29/419 |
| 3,864,808 | 2/1975 | Doser | 72/700 |
| 3,936,277 | 2/1976 | Jakway et al. | 428/611 |

*Primary Examiner*—Lowell A. Larson

[57] ABSTRACT

A method of hot forming bends or deflections in preconsolidated metal matrix composite panels comprised of unidirectional filaments of boron, borsic, alumina, or graphite in aluminum or titanium base metals without limitation of orientation of the filaments relative to axes of the formed bends or deflections.

21 Claims, 6 Drawing Figures

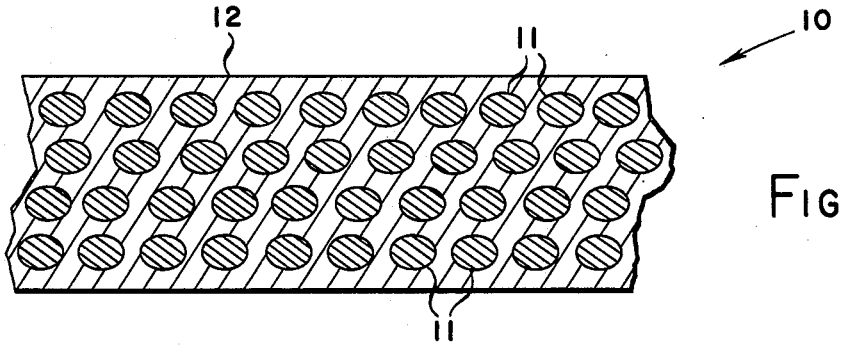
FIG. 1
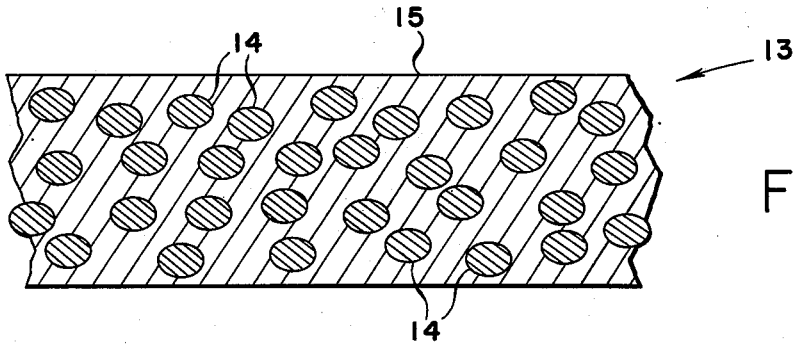
FIG. 2
FIG. 3
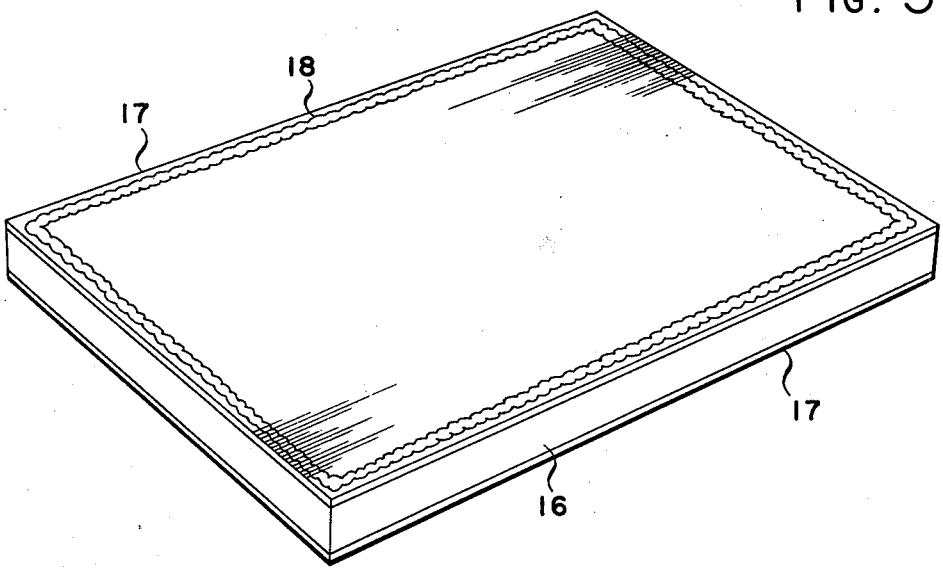

FORMING OF PRECONSOLIDATED METAL MATRIX COMPOSITES

This invention relates to the forming of metal matrix composites, and more specifically to the hot forming of preconsolidated metal matrix composite panels comprised of aluminum or titanium base metals containing boron, borsic, alumina, or graphite material filaments whereby bends or deflections can be formed in the panels without regard to the orientation of the filaments relative to the axes of bends or deflections formed in the panels.

Preconsolidated metal matrix composites comprise a new family of sheet or panel materials that are of considerable interest to the technical and manufacturing or fabrication arts where strength-to-weight ratios are of great importance. It has become found and known in the prior art that these metal matrix composites with preconsolidated layers or plies of unidirectional filaments approximate the ultimate tensile strength and stiffness properties of high-strength steels, but weigh less than aluminum; they have very high fatigue and sonic fatigue strengths; and they are extremely resistant to fatigue crack growth as compared to the conventional sheet materials of steel, aluminum and titanium. These metal matrix composite materials are also without the problems of moisture absorption, temperature usage limitations, and electrical conductance usually encountered with fiber reinforced resin composite materials.

Despite the valuable physical properties of the metal matrix composite panels recited above, serious limitation in application of these materials have heretofore resulted due to the inability of forming or shaping a panel member with the filaments arranged other than substantially parallel to the axis of a bend or deflection. In other words, it has been known that unless the filaments of each layer or ply of the composite were oriented in a direction substantially parallel to the axis of a unidirectional bend or deflection, the amount of bend or deflection was extremely limited to very large radius otherwise filaments would become ruptured and broken with a resultant loss or substantial reduction in the strength properties that would have been attained in the formed part had such filaments remained unbroken or unruptured.

By practice of this invention, metal matrix composite can be formed with bends or deflections well beyond the heretofore limitations, and without concern or regard to the relative orientation of filaments in adjacent layers or plies.

Accordingly, it is an object of this invention to provide a method or process for hot forming preconsolidated metal matrix composites by which bends or deflections of small radii can be formed without damage to the reinforcing filaments and maintaining the continuity thereof.

A further object of this invention is to provide a method or process for hot forming preconsolidated metal matrix composites wherein the composite material can respond satisfactorily to hot forming without unacceptable or uncontrolled distortion.

Another object of this invention is to provide a method or process for hot forming preconsolidated metal matrix composites with unlimited directional orientation of the filaments to the direction of bends or deflections and with unlimited orientation of filaments in adjacent layers or plies relative to each other.

And yet another object of this invention is to provide hot formed preconsolidated metal matrix composite members or workpieces resulting from the above objects of the invention.

Other objects and advantages of this invention will become apparent to those skilled in the art when considering the following description in conjunction with the accompanying drawings in which:

FIG. 1 is an enlarged cross-sectional area of a preconsolidated metal matrix composite sheet made by diffusion bonding;

FIG. 2 is an enlarged cross-sectional area of a preconsolidated metal matrix composite sheet made by casting;

FIG. 3 is an enlarged cross-sectional view of a preconsolidated metal matrix composite workpiece stock having titanium face sheets welded thereto preparatory to forming of the composite workpiece stock in certain embodiments of this invention;

Figure 5:
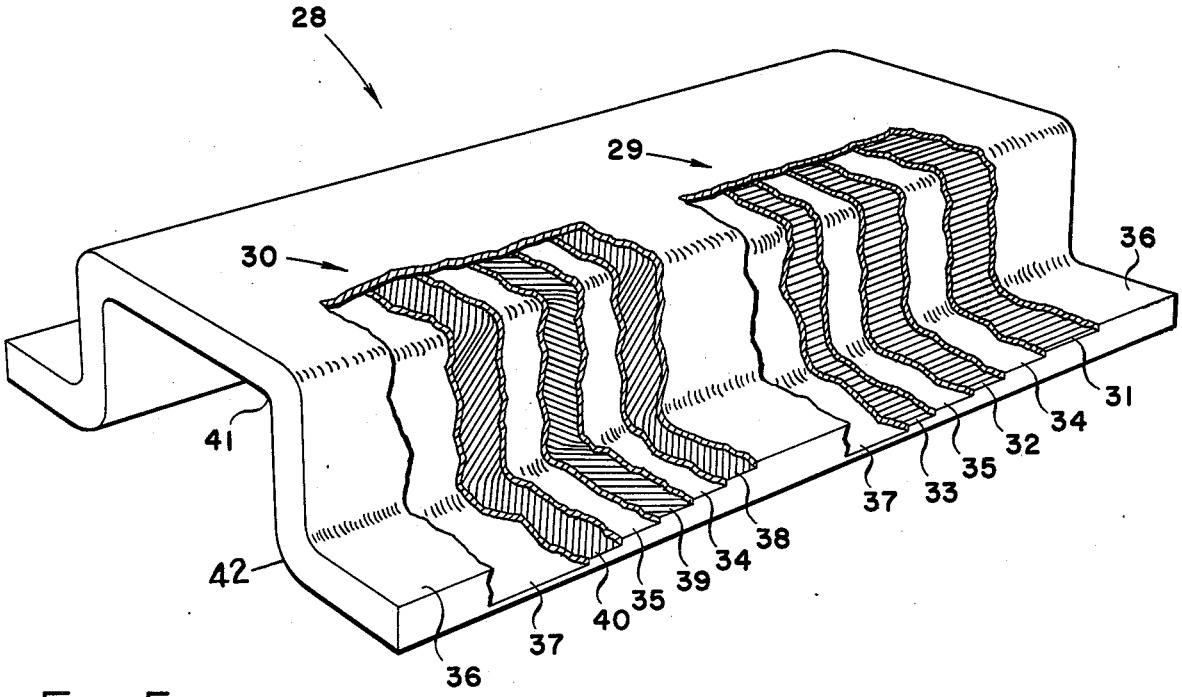
Figure 6:
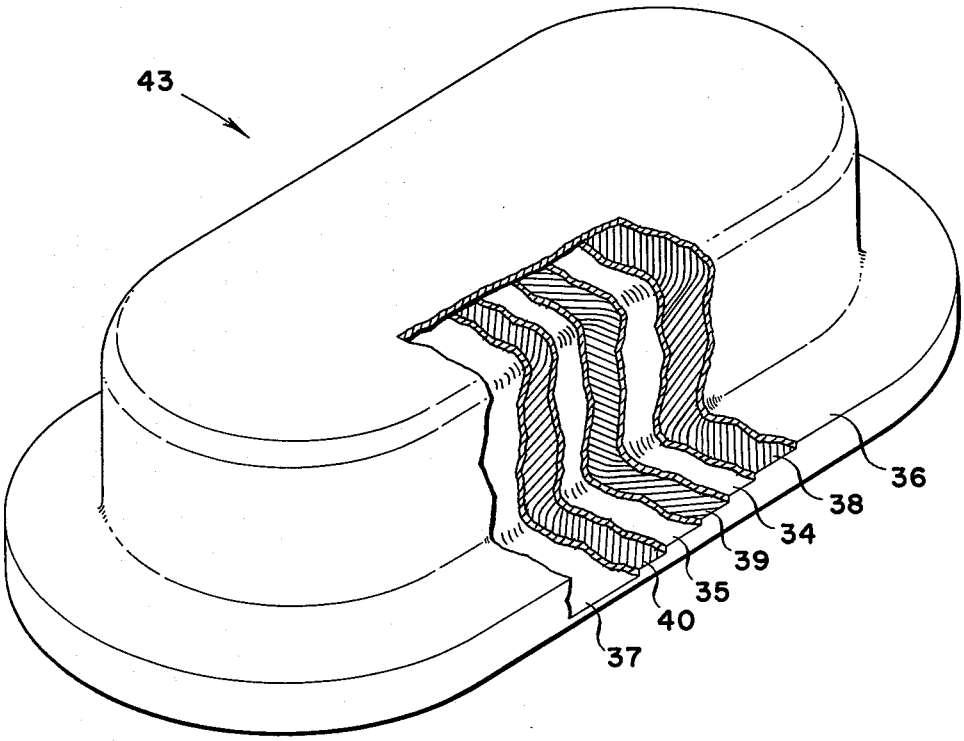

FIG. 5 is a perspective view of a section of a channel member of preconsolidated metal matrix composite formed by practice of this invention with various surface and layer segments partially cut-away to show filament orientations; and, FIG. 6 is a perspective view of a flanged pan formed of preconsolidated metal matrix composite sheet by practice of this invention with a portion of surface and layer segments partially cut-away to show filament orientations.

Generally stated, this invention involves heretofore unattainable forming of preconsolidated metal matrix composite sheets containing unidirectional filaments extending angularly relative to the axis of a bend or deflection by a method or process that can be generically identified as hot creep forming. Various combinations of materials to form such preconsolidated metal matrix composites are known or have been made, and constitute prior art that forms no part of this invention as this invention is only concerned with the hot forming of workpieces originating from preconsolidated metal matrix composites of sheet or panel form.

The method or process of the invention involves the selective practice from the plurality of parameters comprising in the order of what is believed to be descending importance: an enclosure or enveloping containment of the workpiece during forming; forming temperature; die closing rate; die surface finish; closure angles on male die members; die clearance; dwell time after completion of die closure; and lubricant. Details of the parameters, along with the selectivity reasoning for the various parameters for forming the various types of preconsolidated metal matrix composites are discussed in more detail hereinafter.

The prior art family of preconsolidated metal matrix composites, the manufacturing details of which form no part of this invention, includes those composites with typical cross-sections shown in FIGS. 1 and 2. In FIG. 1 the composite sheet or panel 10 is shown in cross-section and comprises a plurality of layers of unidirectional filaments 11 in a base metal 12. The filaments 11 of composite 10 may be of pure boron, boron on a graphite or tungsten substrate, borsic (boron with a coating of silicon carbide), or graphite, with the base metal 12 being of aluminum or titanium. Fabrication of composite 10, which forms no part of this invention, is accomplished by the lay-up of thin sheets or foils of the base metal 12 with layers of filaments 11 placed unidirectionally and interlamellarly between the sheets or foils of base metal 12 whereupon the lay-up is placed in a preconsolidated state by pressure diffusion bonding. Layers of filaments 11 can be oriented relative to each other in the lay-up in any desired manner to permit variation in load carrying and distribution properties of the composite 10 sheet or panel thereby attaining a variety of strength-weight efficiencies in composite 10. For example, the composite 10 depicted in FIG. 1 consists of four layers of filaments 11 with the alternate layers at a ±45° to the plane of the drawing, or in other words, the filaments 11 of each layer are unidirectionally aligned at substantially 90° or right-angles to the filaments 11 in adjacent layers. Also, as an exemplification only and forming no limitations to the invention, a typical four-ply composite 10 of FIG. 1 would consist of four plies of approximately 5.6 mil diameter filaments (1 mil =0.001 inch), with approximately 1.8 mil thick sheets or foils of base metal between adjacent filaments layers and approximately 3.5 mil thick face sheets on the outer surface of the outer filament layers which after pressure diffusion bonding results in a preconsolidated metal matrix composite sheet or panel of approximately 29 mils thick having approximately 45 to 49 percent of the volume as filaments.

In FIG. 2, the composite sheet or panel 13 shown in cross-section comprises a plurality of unidirectional alumina filaments 14 of poly-crystalline $Al_2O_3$ cast in an aluminum or titanium base 15. With the fabrication of composite 13 as a preconsolidated metal matrix by casting rather than pressure diffusion bonding, the filaments 14 are not in the layered order of filaments 11 in composite 10, but various filaments 14 can be angularly oriented to other filaments 14 during the layout of filaments before casting the base metal 15 so as to achieve a variety of relative filament orientations in composite 13 in much the same manner attainable in composite 10. Also, it is to be noted that by casting composite 13, surface portions of some filaments 14 may be exposed to form a part of the surface of composite 13 rather than be completely surrounded by the base metal 15 as occurs in composite 10 with filaments 11 being substantially completely surrounded by base metal 12.

Turning now to discussion of the parameters or steps of this invention as listed above, the one believed most pertinent to some of the composites to be formed is that of enclosing or enveloping of the panel or sheet workpiece during forming. As indicated above, it has been known in the prior art that bending or forming of preconsolidated metal matrix composites with unidirectional filaments extending other than substantially parallel to the axis of a bend or deflection has resulted in the fracture or breaking of the filaments with a resultant loss or reduction of the physical strength properties in the composite attained by the presence of the filaments. It has been found in the practice of this invention that the same difficulty of filament breakage or fracture occurs with some composites unless the outer, flat surfaces of the workpiece blank is enclosed or covered in a manner as shown in FIG. 3. Here there is shown a workpiece stock sheet or panel 16 of a composite 10 or 13 having an upper and lower titanium face sheet 17 connected to the outer, flat surfaces of workpiece stock 16 by a weld 18. This weld 18 extends completely around the periphery by seam welding or overlapping spot welds so as to completely surround the inner area portion of composite stock 16 that will constitute the area of the formed composite workpiece after forming for after forming, the face sheets 17 and welds 18 will be removed by cutting or other appropriate removal to attain the formed workpiece of stock 16 with a portion of its edges removed.

The face sheets 17 are of titanium in a commercially pure state or alloy; and may be in a work hardened or annealed condition, although an annealed condition is preferable due to the lesser springback properties thereof during cool down after forming that are reactive on the enclosed workpiece. Thickness of face sheets 17, while not critical, are preferably in the order of approximately 0.016 inch: thicker resulting in greater springback properties to be factored in during cool down, and thinner resulting in greater cost for the thinner sheet material.

As stated above, enclosure or containment by face sheets 17 are required or important with forming only some of the composites by this invention, namely when forming preconsolidated metal matrix composites containing filaments that are coated such as in borsic composites where the boron filaments are coated with silicon carbide as a diffusion barrier at higher temperatures; composites containing filaments that are formed or made on a substrate such as boron filaments on a carbon substrate; and composites fabricated by casting such as composites 13 discussed above. Composites that do not meet at least one of the three immediately preceeding limitations may be formed by omitting the use of face sheets 17 and utilizing the following discussed parameters of this invention.

The forming temperature is believed to be the second most pertinent factor for forming composites necessitating enclosure in face sheets 17, but of first importance to composites without such face sheet containment. Forming is accomplished with the workpieces and dies in the temperature range of from approximately 910° F. to approximately 935° F., and preferably at a temperature of 925° F. with a tolerance of +10° F. and −15° F. Forming below this temperature range results in less plasticity of the metal matrix causing damage to the filaments during the forming, while forming above the temperature range presents a variety of problems of starting to get eutectic melting of aluminum base metals, degradation of filaments, and loss of alumina filament orientations in cast composites.

After the composite and forming die are brought up to temperature, the die closure or forming strain rates can be varied from 5 to 15 mils per minute with the most preferable range being from 8 to 12 mils per minute. Principles involved with the die closure rate are the shallower the form, the greater the bend radii, and the smaller the orientation angle between the filaments and the bend axis, the greater the closure rate, and vice versa. Should the closure rate be too great, the workpiece material will fracture, and if too low results in time wasting forming inefficiencies. Also, it should be recognized that as the die members approach complete closure for a deep form or about small radii, it may be preferable to slow the closure rate as the composite workpiece approaches the maximum forming strain.

Figure 4:
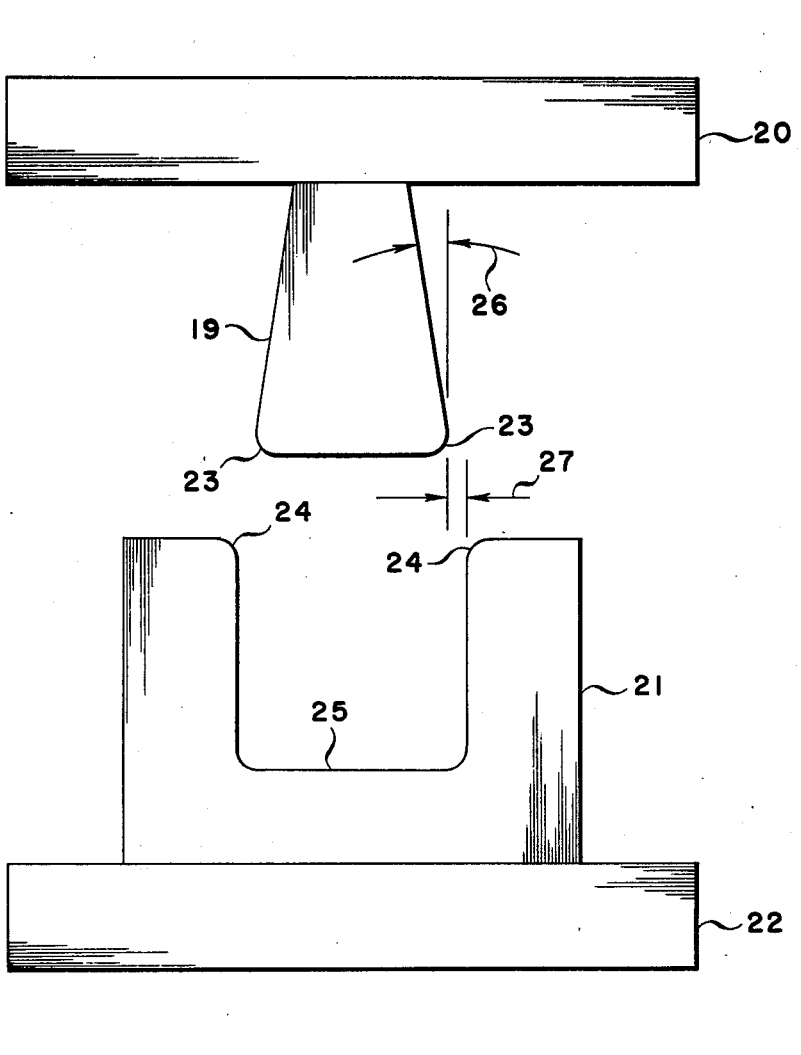
FIG. 4 is a cross-sectional view of one embodiment of forming tooling principles involved in the practice of this invention.

The next order of importance is believed to be surface finish on portions of the forming die. With reference to FIG. 4, one embodiment of a forming die used in the practice of this invention comprises a male die member 19 mounted to an upper press platen 20 and a female die member 21 mounted to a lower press platen 22. Closing alignment of die members 19 and 21 is maintained by any appropriate conventional means (not shown) so that as male die member 19 moves into enclosure with female die member 21, a composite workpiece extending across the space between die members 19 and 21 at right angle to the direction of closure becomes formed to a configuration resulting from the die member shapes. During forming, the composite workpiece will have work forming or sliding contact or engagement with shoulders or corners 23 on male die member 19 and shoulders or corners 24 on female die member 21; the radii of shoulders 23 and 24 forming the bend radii of the formed composite. The radii surfaces of shoulders 23 and 24 are die or draw polished to a finish of 8–16 RHR (Roughness Height Rating) or RMS (Root Mean Square) to minimize, if not eliminate, tool marks on the workpiece during forming by reducing pickup of the workpiece material by the tooling during forming. Also, when forming composites that are not contained by face sheets 17, it is preferable, though not mandatory or critical, to put a grinding finish on the bottom recess surface 25 of female die 21 to minimize, if not eliminate, surface defects on the composite surface that may appear from the pressure contact of the tooling surface with the relatively soft composite surface resulting from the forming temperature. Because of inherent springback qualities in preconsolidated metal matrix composites formed by this invention, the application of what is known in the prior art as draft angle or closed angle tooling is preferably incorporated in male die members as represented by angle 26 on male die member 19 in FIG. 4. This angle 26 results in overforming of the composite workpieces to compensate for at least some of the inherent springback that occurs when the composite is removed from the tooling after forming. The range of angle 26 is from approximately 3° to approximately 15°; it being recognized a greater draft angle 26 should be utilized when any one or more of certain conditions apply or are present—namely, the thicker the composite the greater the draft angle, the greater the angulation of filament to the bend axis the greater the draft angle, the less the post-forming dwell time in the tooling (discussed below) the greater the draft angle, and the greater the resistance to bending by the filament material the greater the draft angle.

Of the generic 3°–15° range for angle 26 discussed above for forming preconsolidated metal matrix composites, more preferable ranges for specific filament materials are approximately 3 to 5 degrees for boron filaments, approximately 5 to 10 degrees for borsic filaments, and approximately 7 to 15 degrees for both graphite and alumina filaments.

The next item in the believed order of importance is that of forming die clearance or the spacing between the female die sidewalls and male die surfaces during die closure as represented by clearance dimension 27 in FIG. 4. This dimension 27 preferably ranges from approximately 1.3 to approximately 1.5 times the thickness of the composite being formed; the term composite thickness including the face sheets 17 when they are used. The importance of clearance provided by control of dimension 27 is that if there is too much clearance there is insufficient control, if any, of springback resulting in an inefficient forming of the workpiece blank, and too little clearance results in too much rubbing between the workpiece blank and tooling surfaces during forming which in turn causes damage to the composite filaments.

Post forming dwell time is the last major factor of concern to the practice of this invention, and is the period following the complete closure of the die members with the formed workpiece and the tooling maintained at the above discussed forming temperature. This comprises a preferable period of from approximately 15 minutes to approximately 30 minutes, and an exact amount is both dependent and variable upon other factors. For example, the shallower the draw or greater the radius, the longer the dwell time; also, since there is less springback with longer dwell times, a smaller or lesser draft angle on tooling can be employed; or in other words, the shorter the dwell time, the more the material has to be overformed to reduce springback the more subject the workpiece is to filament damage. Dwell times longer than approximately 30 minutes are believed ineffective, resulting in only a waste of time and energy.

The last item from the above listing involves the coating of the workpiece blank with a lubricant before forming. While this is not a critical or mandatory feature, it can be of assistance in forming deep draws by further minimizing rubbing contact between the blank and die surfaces, and hence, further minimization to the potential of filament damage or breakage as well as wear of die surfaces since the harder the die material the lesser the importance of a lubricant. A typical workpiece lubricant of the kind discussed above is one marketed under the trade name "Formkote T-50" by E/M Lubricants Inc., of North Hollywood, Calif.

With reference now to FIG. 5, there is shown a longitudinal extending channel workpiece 28 depicting one section of layered cutaways 29 representing the limitation of filament layer orientations in the prior art and a second section of layered cutaways 30 representing the greater strength-to-weight ratio filament layer orientations permitted by practice of this invention. Section 29 depicts in cutaway fashion three layers of filaments 31, 32, 33, with base metal sheets or foils 34 and 35 respectively intermediate filament layers 31–32 and 32–33 and base metal face sheets 36 and 37. As indicated above, the depicted orientation of filament layers 31, 32, 33 so that they all extend unidirectionally parallel to the axis of any bend or deformation, whether formed by heat or creep forming, was a limitation of the prior art in forming preconsolidated metal matrix composites to avoid damage or breakage of the filaments, and hence loss of strength. Through practice of this invention, it has been found that such composites can be formed with filaments extending unidirectionally angulated relative to adjacent layers as well as to the bend or deformation axis without damage or breakage of filaments in a manner typified by cutaway section 30. Here there is shown three layers of filaments 38, 39, 40 with intermediate base metal sheets or foils 34, 35 and face sheets 36, 37; the orientation of filament layers 38, 39 and 40 being such that filaments in layer 39 extend unidirectionally at 90° to the filaments in layers 38 and 40, with the overall filament orientation of layers 38, 39, 40 being ±45° to the axes of bends or deformations resulting in corners 41, 42 of workpiece 28. Thusly, not only is a composite formed according to the depiction shown in section 30 capable of carrying greater loads and have a greater strength-to-weight ratio than a composite according to section 29 due to the angulation of filament layers to the bend axis, but the strength-to-weight ratio is even further enhanced by the relative angulation of filaments between adjacent layers thereof as shown in section 30.

Referring now to FIG. 6, there is shown a flanged pan workpiece 43 formed by this invention which was considered completely unformable from a preconsolidated metal matrix composite by the prior art due to the inherent necessity of angulating filaments to a bend axis even with composites containing filament orientations as shown in section 29 of FIG. 5. The cutaway section 44 of pan 43 is the same as section 30 of FIG. 5 with filament layers 38, 39, 40 oriented in the same manner and located between base metal sheets 34, 35, 36, 37 as described above.

In summary, it can be seen that by appropriate use and combination of tooling and process parameters as described above, hot or creep forming of preconsolidated metal matrix composites are accomplishable in accordance with the objectives of this invention recited above.

While specific embodiments of the invention have been illustrated and described, it will be obvious to those skilled in the art that various changes and modifications may be made without departing from the invention and it is intended to cover in the appended claims all such modifications and equivalents that fall within the true spirit and scope of this invention.

I claim:

1. A method of forming bends or deflections in a preconsolidated metal matrix composite workpiece consisting of boron, borsic, alumina or graphite filaments in aluminum or titanium base metals, said method comprising the steps of:

(a) locating the composite workpiece between open male and female members of a forming die;

(b) bringing the workpiece and at least the die faces to a temperature of from approximately 910° F. to approximately 935° F.; and, (c) closing the die members at a rate of from 5 to 12 mils per minute after both male and female die members are in contact with the workpiece and until the die members are completely closed.

2. A method as claimed in claim 1 wherein after complete closure of the die members, they are maintained closed for a post-forming dwell time of from approximately 15 minutes to approximately 30 minutes.

3. A method as claimed in claim 1 wherein prior to location of the composite workpiece in step (a), titanium sheets are secured to the face surfaces of said composite workpiece by a weld line that completely encloses the face surface area of the workpiece being formed, and removal of the titanium sheets and weld line from the formed workpiece after the workpiece is removed from the forming die.

4. A method as claimed in claim 3 wherein the thickness of the titanium face sheets are approximately 0.016 inch.

5. A method as claimed in claim 1 wherein at least part of the surface portions of the die members forming the inner radius of at least one deformation in the formed workpiece is draw polished to a finish of 8–16 RMS.

6. A method as claimed in claim 1 wherein at least one workpiece forming surface of at least one of said die members includes a springback angle of from approximately 3° to approximately 15°.

7. A method as claimed in claim 1 wherein the clearance between a forming surface of the male die member and a confronting female die member surface that is traversed by said male die member surface during die closure is from approximately 1.3 to approximately 1.5 times the thickness of the workpiece.

8. A method as claimed in claim 6 wherein the workpiece filament material is of boron, and the springback angle ranges from approximately 3° to approximately 5°.

9. A method as claimed in claim 6 wherein the workpiece filament material is of borsic, and the springback angle ranges from approximately 5° to approximately 10°.

10. A method as claimed in claim 6 wherein the workpiece filament material consists of alumina or graphite, and the springback angle ranges from approximately 7° to approximately 15°.

11. A male and female member tool die set for forming bends or deflections in a preconsolidated metal matrix composite workpiece consisting of boron, borsic, alumina or graphite filaments in aluminum or titanium base metals such that at least one bend or deflection is oriented so that at least some of the filaments of the composite workpiece are angulated to at least one bend or deflection axis with said forming accomplished at a temperature of approximately 910° F. to approximately 935° F. for the workpiece and at least the die member forming faces, said tool die set containing the properties of:

(a) at least part of the surface portions of the die members forming the inner radius of at least one deformation in the formed workpiece is polished to a finish of 8–16 RMS;

(b) at least one workpiece forming surface of at least one of said die members includes a springback angle of from approximately 3° to approximately 15°; and, (c) the clearance between a forming surface of the male die member and a confronting female die member surface that is traversed by said male die member surface during die closure is from approximately 1.3 to approximately 1.5 times the thickness of the workpiece.

12. A formed workpiece of a preconsolidated metal matrix composite consisting of boron, borsic, alumina or graphite filaments in aluminum or titanium base metals having at least one bend or deflection formed in the workpiece with at least some of the filaments of the composite workpiece located at an angle to the axis of the bend or deflection with said forming resulting from:

(a) locating the composite workpiece between open male and female members of a forming die;

(b) bringing the workpiece and at least the die faces to a temperature of from approximately 910° F. to approximately 935° F.; and, (c) closing the die members at a rate of from 5 to 12 mils per minute after both male and female die members are in contact with the workpiece and until the die members are completely closed.

13. A formed preconsolidated metal matrix composite workpiece as claimed in claim 12 in which the forming of the workpiece included the complete closure of the die members maintained for a post-forming dwell time of from approximately 15 minutes to approximately 30 minutes.

14. A formed preconsolidated metal matrix composite workpiece as claimed in claim 12 in which the forming of the workpiece included before locating the composite workpiece between the open male and female members of the forming die the securing of titanium face sheets to the face surfaces of the workpiece by a weld line that completely enclosed the face surface area of the formed workpiece, and the titanium face sheets and weld line removed from the formed workpiece after removal thereof from the forming die.

15. A formed preconsolidated metal matrix composite workpiece as claimed in claim 14 wherein the thickness of the titanium face sheets were approximately 0.016 inch.

16. A formed preconsolidated metal matrix composite workpiece as claimed in claim 12 wherein at least part of the surface portions of the die members forming the inner radius of at least one deformation in the formed workpiece were draw polished to a finish of 8–16 RMS.

17. A formed preconsolidated metal matrix composite workpiece as claimed in claim 12 wherein at least one workpiece forming surface of at least one of said die members included a springback angle of from approximately 3° to approximately 15°.

18. A formed preconsolidated metal matrix composite workpiece as claimed in claim 12 wherein the clearance between a forming surface of the male die member and a confronting female die member surface that was traversed by said male die member surface during the forming die closure was from approximately 1.3 to approximately 1.5 times the thickness of the workpiece.

19. A formed preconsolidated metal matrix composite workpiece as claimed in claim 17 wherein the workpiece filament is of boron, and the springback angle ranged from approximately 3° to approximately 5°.

20. A formed preconsolidated metal matrix composite workpiece as claimed in claim 17 wherein the workpiece filament is of borsic, and the springback angle ranged from approximately 5° to approximately 10°.

21. A formed preconsolidated metal matrix composite workpiece as claimed in claim 17 wherein the workpiece filament is of alumina or graphite, and the springback angle ranged from approximately 7° to approximately 15°.

* * * * *

UNITED STATES PATENT AND TRADEMARK OFFICE

CERTIFICATE OF CORRECTION

PATENT NO. : 4,163,380

DATED : August 7, 1979

INVENTOR(S) : VERNON W. MASONER

It is certified that error appears in the above-identified patent and that said Letters Patent are hereby corrected as shown below:

Column 7, line 38 and Column 8, line 54, the numeral "12" should read -15-.

Signed and Sealed this

*Twelfth* Day of *August 1980*

[SEAL]

*Attest:*

SIDNEY A. DIAMOND

*Attesting Officer*

*Commissioner of Patents and Trademarks*